US007815134B2

(12) United States Patent
Hohl

(10) Patent No.: US 7,815,134 B2
(45) Date of Patent: Oct. 19, 2010

(54) SYSTEM AND METHOD FOR CONTROLLING WATER FLOW IN A FOOD WASTE HANDLING SYSTEM

(75) Inventor: Christopher Hohl, Leawood, KS (US)

(73) Assignee: The Salvajor Company, Kansas City, MO (US)

( * ) Notice: Subject to any disclaimer, the term of this patent is extended or adjusted under 35 U.S.C. 154(b) by 1163 days.

(21) Appl. No.: 11/250,769

(22) Filed: Oct. 14, 2005

(65) Prior Publication Data

US 2007/0084950 A1 Apr. 19, 2007

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |

(52) U.S. Cl. ..... 241/36; 241/46.013; 241/46.016; 4/623; 134/113

(58) Field of Classification Search ..... 241/46.013–46.017, 36; 134/115 G, 113; 4/623, 624

See application file for complete search history.

(56) References Cited

U.S. PATENT DOCUMENTS

| | | | | |
|---|---|---|---|---|
| 2,615,636 | A | | 10/1952 | Powers |
| 2,785,863 | A | | 3/1957 | Jordan |
| 3,300,150 | A | | 1/1967 | Sones et al. |
| 3,545,684 | A | | 12/1970 | Ruspino et al. |
| 4,373,676 | A | | 2/1983 | Sherman, Jr. |
| 4,823,414 | A | * | 4/1989 | Piersimoni et al. ..... 4/623 |
| 5,308,000 | A | | 5/1994 | Riley |
| 5,447,017 | A | | 9/1995 | Becher et al. |
| 5,625,908 | A | * | 5/1997 | Shaw ..... 4/623 |
| 6,131,587 | A | * | 10/2000 | Chardack et al. ..... 134/95.2 |
| 6,135,374 | A | | 10/2000 | Hansen et al. |
| 6,168,723 | B1 | | 1/2001 | Moody |
| 6,261,446 | B1 | | 7/2001 | Cornick |
| 6,576,140 | B1 | | 6/2003 | Batten |
| 6,629,652 | B2 | | 10/2003 | Batten |
| 6,719,226 | B2 | | 4/2004 | Rajewski |
| 6,968,860 | B1 | * | 11/2005 | Haenlein et al. ..... 137/613 |

* cited by examiner

*Primary Examiner*—Bena Miller
(74) *Attorney, Agent, or Firm*—Lathrop & Gage LLP

(57) ABSTRACT

A control system for minimizing overall water use in a food waste handling system while maximizing flow rate when needed by controlling a flow of water into the handling system based on or in response to a physical presence of an operator. The control system substantially automatically senses, detects, or otherwise determines the presence of the operator, wherein such presence is assumptively associated with use of the waste handling system (i.e., the deposition of waste thereinto), and, in response to said presence, automatically controls the flow of water accordingly and for a pre-established period of time following cessation of said presence in order to facilitate the on-going handling process.

20 Claims, 5 Drawing Sheets

SYSTEM AND METHOD FOR CONTROLLING WATER FLOW IN A FOOD WASTE HANDLING SYSTEM

BACKGROUND OF THE INVENTION

1. Field of the Invention

The present invention relates broadly to systems and methods for controlling water flow in food waste handling systems. More specifically, the present invention concerns a system and method for substantially automatically controlling water flow into a disposer, collector, or other type of food waste handling system based on a sensed, detected, or otherwise determined physical presence of an operator, including automatically controlling said flow for a pre-established period of time following cessation of said presence.

2. Description of the Prior Art

Food waste handling systems are known in the prior art, including disposer-based systems that grind or shred and then flush food waste into a sanitary sewer system, and collector-based systems that collect solid food waste for subsequent disposal other than into a sanitary sewer system. For both types of waste handling systems, water is a necessary ingredient at various points in the handling process. In some embodiments, a stream or plume of water is initially provided to apply a force to soiled dishes in order to wash or otherwise remove food waste therefrom. To that end, it is known to provide a continuous plume of water into a basin or trough associated with the waste handling system. In a disposer-based system, water is also used to carry the food waste into the disposer device, facilitate grinding or shredding, and carry or flush the ground or shredded food waste into and through the sanitary sewer system. In a collector-based system, water is also used to carry solid components of the food waste into a collection area for deposition therein and subsequent removal, and to carry away non-solid components.

In each case, an increased flow of water may sometimes be necessary or desirable to facilitate the washing, grinding or shredding, deposition, or flushing operations. This is the case, for example, when handling large amounts of food waste or especially dense or dry food waste. In one prior art disposer-based system, for example, water flow into the disposer is increased in response to a sensed increase in electric current drawn by a motor driving the grinding or shredding operation. The sensed increase in current draw is used as an indication that additional water may be needed to facilitate particularly difficult grinding or shredding.

It will first be appreciated that such a prior art waste handling system could not be adapted for use with a collector-based or other type of waste handling system which may not draw current or in which increased current draw is not a satisfactory indicator of a needed increase in water flow. It will also be appreciated that there are a number of points in the handling processes of most systems, regardless of the type of processing device, where increased water flow may be necessary or desirable regardless of the amount of current drawn by any motor. It may be desirable, for example, to increase water flow at any point in the handling process from removing the food waste from the dishes, carrying it into the processing device, or flushing it through the sanitary sewer system. Carrying food waste into the processing device is of particular concern in trough-type systems wherein the food waste may be deposited into the trough some distance from the processing device such that an increased flow is needed to physically push the food waste down the trough. With regard to flushing the food waste into and through the sanitary sewer system, the aforementioned prior art system increases and decreases water flow in response to current draw during grinding and shredding but without any concern for flushing the waste thereafter. Thus, as a general matter, it is sometimes desirable to increase flow whenever waste is being handled and not merely during short intervals of difficult grinding or shredding.

It is, of course, known for an operator to manually increase water flow, such as by opening or further opening a water valve. A substantial risk arises, however, that the operator may forget to increase the flow, which may cause handling problems or even damage to the system, or may leave the area without reducing the water flow, which may result in a substantial amount of wasted water and an increase in associated operating costs.

Due to the above-identified and other problems and disadvantages in the prior art, a need exists for an improved system and method for controlling water flow in a food waste handling system.

SUMMARY OF THE INVENTION

The present invention overcomes the above-described and other problems and disadvantages in the prior art by providing an improved system and method for controlling water flow into a food waste handling system. Broadly, the present invention facilitates minimizing overall water use in the waste handling system while maximizing flow rate when needed by controlling water flow into the waste handling system based on or in response to a physical presence of an operator. More specifically, the control system is adapted and operable to substantially automatically sense, detect, or otherwise determine the presence of the operator, wherein such presence is assumptively associated with use of the waste handling system, and, in response to said presence, automatically control the flow of water accordingly and for a pre-established period of time following cessation of said presence in order to facilitate the on-going handling process.

In a preferred embodiment and implementation, the control system of the present invention may be made to function generally as follows. Initially, an operator physically approaches and manually powers the waste handling system by, e.g., actuating an ON switch, which causes both first and second water flows to be provided, thereby resulting in maximum combined water flow. A proximity sensor detects the operator's initial and continued presence. When or a few seconds or minutes after the operator's presence is no longer detected, indicating that he or she has stepped away from the waste handling system and is no longer depositing waste, the second flowpath closes, thereby substantially reducing but not eliminating water flow, and a timer begins to measure a pre-established time period during which the first flowpath remains open to continue facilitating aspects of the handling process still in progress. If the operator's presence is re-detected before the measured time period ends, then the second flowpath re-opens, and when the operator steps away again the timer is re-initiated to begin measuring the pre-established time period in its from the beginning. If the operator's presence is not re-detected before the measured time period ends, then the first flowpath closes as well.

From the description set forth herein, it will be appreciated that the control system and method of the present invention provide a number of substantial advantages over the prior art, including, for example, automatically controlling water flow to facilitate all or certain aspects of the handling process. By contrast, the prior art provides increased water flow only during the grinding or shredding process and only in response to increased current draw. Furthermore, the present invention continues to provide water flow for a pre-established period of time in order to facilitate the handling process to completion. By contrast, the prior art ceases to provide water flow once motor current draw drops to normal levels, but this neither ensures that food waste still traveling to the basin (i.e., down a connecting trough) reaches the basin nor ensures that ground or shredded food waste is adequately flushed into and through a connected sanitary sewer system. Additionally, the present invention is usable with collector-based and other waste handling systems in which there is no current draw or in which current draw is not a satisfactory indicator of a needed increase in water flow.

These and other important features of the present invention are more fully described in the section titled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF THE PREFERRED EMBODIMENTS

With reference to the figures, a control system is herein described, shown, and otherwise disclosed in accordance with various preferred embodiments of the present invention. Broadly, the control system facilitates minimizing overall water use in a food waste handling system while maximizing flow rate when needed by controlling water flow into the waste handling system based on or in response to a physical presence of an operator. More specifically, the control system is adapted and operable to substantially automatically sense, detect, or otherwise determine the presence of the operator, wherein such presence is assumptively associated with use of the waste handling system (i.e., the deposition of waste thereinto), and, in response to said presence, automatically control the flow of water accordingly and for a pre-established period of time following cessation of said presence in order to facilitate the on-going handling process.

Figure 1:
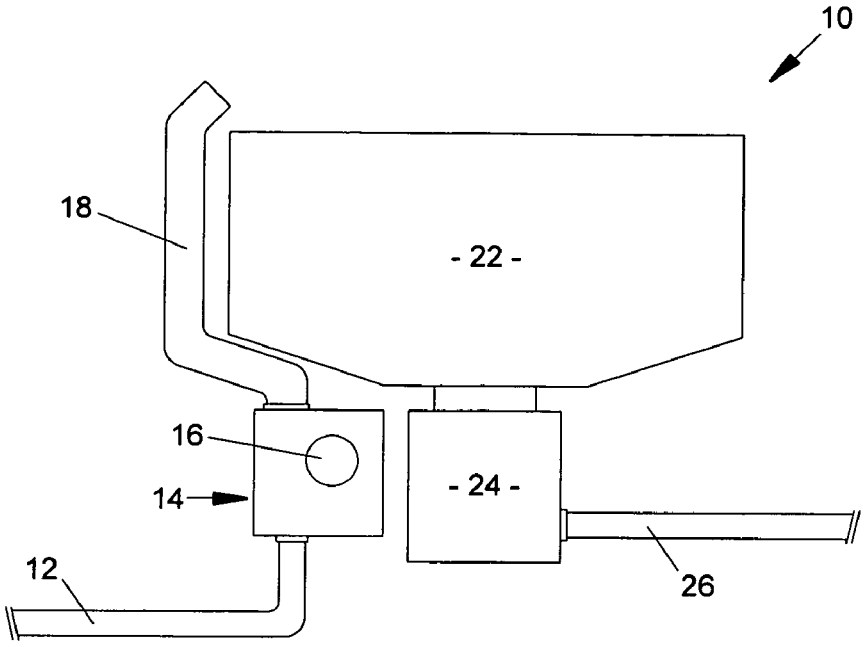
FIG. 1 is a high-level system diagram of a simple exemplary single-operator food waste handling system incorporating a preferred first embodiment of the control system of the present invention.

Advantageously, the control system may be used in substantially any type of waste handling system, including, for example, disposer, collector, single-operator, and multi-operator trough-type systems. For purposes of illustration, and not by way of limitation, a simple exemplary waste handling system 10 is depicted in FIG. 1 broadly comprising a water supply conduit 12; a preferred first embodiment of the control system 14 of the present invention, including a presence sensor 16; a water delivery outlet 18; a basin 22; a processing device 24; and a drain connection 26 to a sanitary sewer system.

The water supply conduit 12 delivers an initial water flow to the waste handling system 10. The supply conduit 12 is connected at a first end to a water supply and at a second end to the control system 14. The water supply may be substantially any suitable source of water, such as a municipal water supply system, and may include, at least in part, water recycled from the basin 22.

Figure 2:
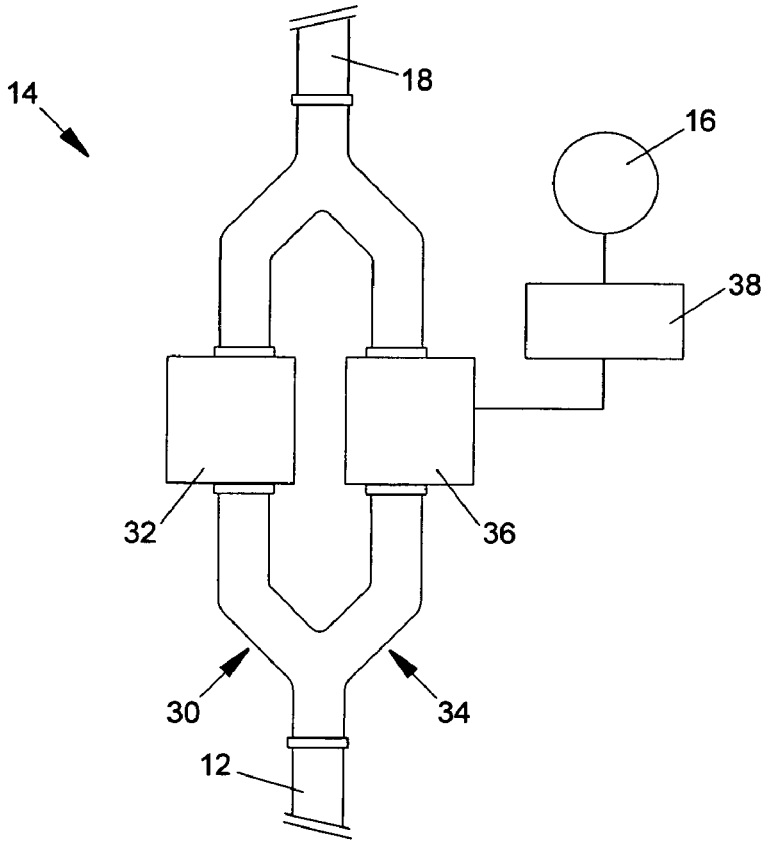
FIG. 2 is a detailed block diagram of the preferred first embodiment of the control system shown in FIG. 1.

The control system 14 receives this water flow and controls its subsequent flow through the water delivery outlet 18 and into the basin 22. More specifically, the control system 14 provides at least two different flow rates: a first minimum flow of approximately between 1 gallon per minute and 6 gallons per minute, and a second increased flow of approximately between 2 gallons per minute and 12 gallons per minute. Actual flow rates will, however, depend greatly on application and design, and substantially higher or lower flow rates than those identified herein may be needed or desired for specific food waste handling applications. Referring also to FIG. 2, the control system 14 includes the presence sensor 16; a first flowpath 30 including a first flow control device 32; a second flowpath 34 including a second flow control device 36; and a controller 38.

The presence sensor 16 senses, detects, or otherwise determines the physical presence of the operator in close proximity with the waste handling system 10, and outputs an electronic "presence" signal when said presence is determined. The sensor 16 may be any otherwise substantially conventional presence-sensing device such as, for example, any suitable sensor using infrared, ultrasonic, motion, thermal, or similar presence-sensing technologies. The sensor 16 may be physically incorporated into or mounted externally on the waste handling system, or a connection may be provided for connecting the sensor 16 when and as desired. The necessary or desired range within which the sensor 16 is able to determine the presence will depend to some extent on the location of the sensor 16 and the design of the waste handling system 10 generally. It is contemplated, however, that the maximum range will be no more than approximately two feet to avoid detecting the presences of others who are not immediate operators of the waste handling system (i.e., not depositing waste thereinto). It is also contemplated that the sensor's range or field may be adjustable to further avoid undesired detections.

It is also contemplated that the presence sensor 16 may be an otherwise substantially conventional device for sensing physical contact, weight, or pressure, incorporated into a mat or other substantially horizontal floor covering positioned substantially in front of the basin 22. Thus, in this contemplated implementation, the physical presence of the operator is determined based on his or her physical contact with or weight or pressure on the mat. In all other respects, this implementation may be substantially similar or identical to implementations using other types of sensors.

The first flowpath 30 provides a defined default flowpath for water flowing into and through the control system 14 from the supply conduit 12. The first flowpath 30 connects to the delivery outlet 18, such that water flowing through the first flowpath exits the delivery tube 18 over the basin 22. The first flow control device 32 includes a first solenoid and a first electronically-actuated valve for controlling water flow through the first flowpath 30. This valve is automatically opened when power is applied to the waste handling system 10 and the operator's presence is detected, and remains open for a pre-established time period following cessation of said presence, thereby providing a flow of water through the waste handling system 10 whenever food waste is likely being deposited into and processed by the waste handling system 10.

The second flowpath 34 provides a defined supplemental flowpath for water flowing into and through the control system 14 from the supply conduit 12. The second flowpath 30 also connects to the delivery outlet 18. The second flow control device 36 includes a second solenoid and a second electronically-actuated valve for controlling water flow through the second flowpath 34. This valve is also opened automatically when power is applied to the waste handling system 10 and the operator's presence is detected, but remains open only while said presence continues to be detected. Thus this supplemental second flow is combined with the aforementioned first flow to provide a maximum total flow. When or a few seconds or minutes after the operator steps away such that his or her presence is no longer detected, thereby indicating that food waste is no longer being deposited into the waste handling system 10, this valve closes and the second flow terminates. To be clear: the second flow may terminate substantially simultaneously with the operator stepping away or a few seconds or minutes thereafter, but in any case the second flow will terminate before the first flow does. Thus, the second flow may, as necessary or desired, be provided for approximately between 0 seconds and 5 minutes following cessation of the operator's presence. In one contemplated preferred embodiment, for example, the second flow is maintained for approximately 15 seconds.

In another possible implementation, there may be only a single flow control device which is adapted to provide at least the two aforementioned flow rates. In another possible implementation, only a single flow control device is used which can provide only the higher flow rate, in which case the higher flow rate is provided whenever any amount of water flow is called for, including during the pre-established time period after the operator steps away.

The controller 38 receives the presence signal generated by the sensor 16, and, in response thereto, outputs a first "open" signal to the solenoid of the first flow control device 32 to cause the first valve to open initially and to remain open during the pre-established time period. The controller 38 also outputs a second "open" signal to the solenoid of the second flow control device 36 to cause the second valve to open initially and to remain open while the operator's presence continues to be detected. The first "open" signal is maintained for the pre-established time period following cessation of the presence signal in order to facilitate on-going handling operations (e.g., continued grinding, shredding, deposition, or flushing) that may still be in progress even though the operator has left the immediate proximity or vicinity of the waste handling system 10. The pre-established time period is preferably approximately between 5 seconds and 25 minutes but may be longer, and may be fixed or programmable, either by an end-user or by a trained technician. The controller 38 may be provided with an internal timer, an external timer, or a connection for connecting to an external timer for measuring the pre-established time period.

The water delivery outlet 18 guides water exiting from the first and second flowpaths 30,34 into the basin 22. The delivery outlet 18 preferably provides this flow of water in the form of a forceful plume of sufficient strength to remove or facilitate removing food waste from soiled dishes, and, in the case of trough-type systems, to push or otherwise force the removed food waste down the trough and into the basin 22. In one contemplated preferred embodiment, for example, the delivery outlet 18 is a substantially conventional fresh water inlet for the basin 22.

The basin 22 receives both the water exiting the delivery outlet 18 and the food waste removed from dishes. At least some part of the water may be recirculated, and at least some part of the water will flow through the processing device 24 along with the food waste. The basin 22 may be, for example, an otherwise substantially conventional sink or, alternatively, an enclosure component of a dedicated waste handling system.

The processing device 24 is connected to the basin 22 and receives and processes or otherwise handles the food waste deposited thereinto. As previously stated, the processing device 24 may include a disposer having a motor and mechanical elements for grinding or shredding the food waste, a collector for accumulating a substantially solid component of the deposited food waste, or any other desired type of processing mechanism.

The drain connection 26 is connected to the processing device 24 for carrying away the ground or shredded food waste or the substantially non-solid components of the food waste. It will be appreciated that a certain minimum amount of water is desirable and necessary to properly flush the food waste into and through the drain and sanitary sewer system to avoid build-ups and blockages.

Figure 3:
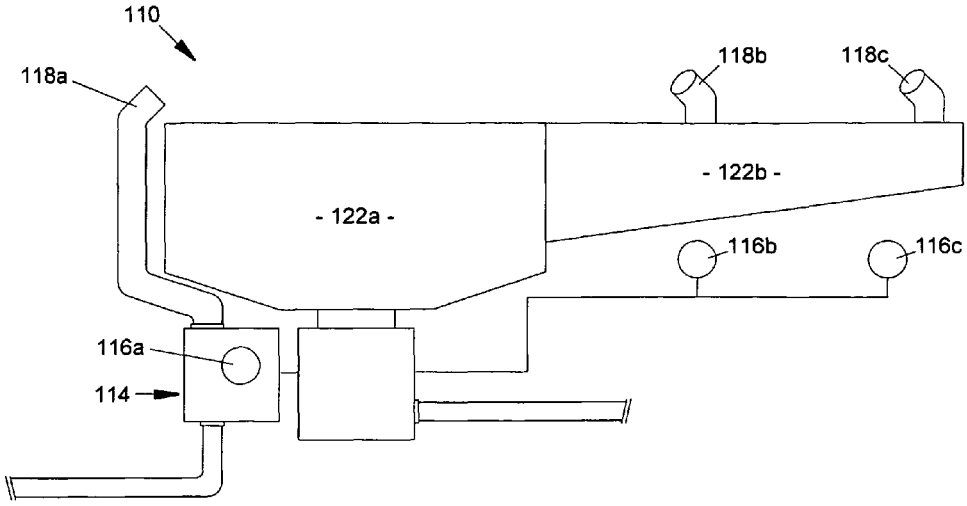
FIG. 3 is a high-level system diagram of a simple exemplary multi-operator trough-type food waste system incorporating a preferred second embodiment of the control system of the present invention.

Referring to FIG. 3, a preferred second embodiment of the control system 114 is shown which may be substantially similar or identical to the above-described first embodiment but for the following differences. The first embodiment is shown incorporated into an exemplary single-operator system 10 having space for only one operator to work at a time. The second embodiment, however, is shown adapted for and incorporated into an exemplary multi-operator trough-type system 110 having a trough-like extension 122*b* connected to the basin 122*a*, and multiple delivery outlets 118*a*, 118*b*, 118*c* located at the basin 122*a* and along the trough 122*b*. Because an operator may position him- or herself to deposit food waste anywhere along the trough 122*b*, the control system 114 may use multiple presence sensors 116*a*, 116*b*, 116*c* positioned at different points along the work area, or, alternatively, the control system may use a single sensor adapted to monitor the entire work area.

Figure 4:
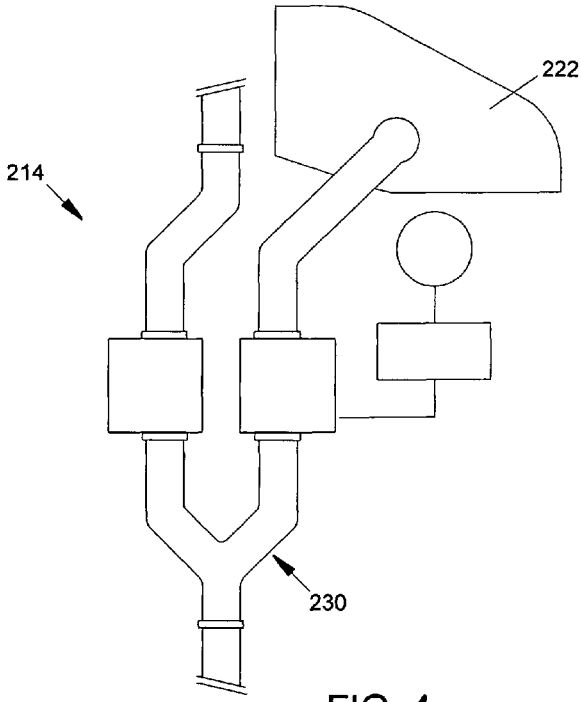
FIG. 4 is a detailed block diagram of a preferred third embodiment of the control system of the present invention.

Referring to FIG. 4, a preferred third embodiment of the control system 214 is shown which may be substantially similar or identical to the above-described first or second embodiments but for the following differences. In these previous embodiments both the first and second flowpaths 30,34 connect to the delivery outlet 18 or 118*a*, 118*b*, 118*c* in order to provide combined flow at the highest or earliest point in the handling process. In the third embodiment, however, the first flowpath 230 connects directly to and introduces its flow at a point lower in the basin 222 which may be between the delivery outlet and an entrance to the processing device or within the processing device, thereby providing its initial and continued flow at the processing stage. It will be appreciated that this third embodiment of the control system 214 can, as desired, be incorporated into a single-operator system, such as is shown in FIG. 1, or into a multi-operator trough-type system, such as is shown in FIG. 3.

It will be appreciated that the first flowpath could also alternatively be connected near or at an exit of the processing device or at the drain connection to provide its initial and continued flow only to the flushing stage.

Figure 5:
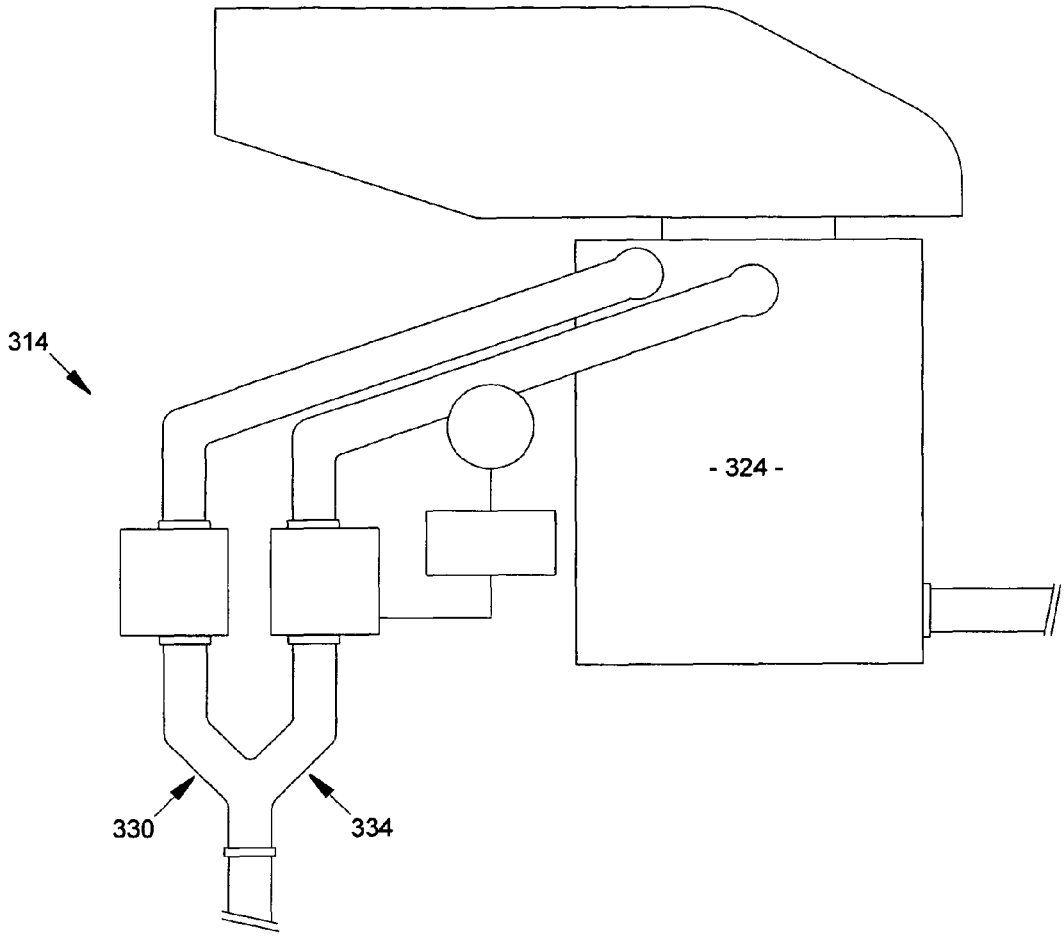
FIG. 5 is a detailed block diagram of a preferred fourth embodiment of the control system of the present invention.

Referring to FIG. 5, a preferred fourth embodiment of the control system 314 is shown which may be substantially similar or identical to the above-described embodiments but for the following differences. In the previous embodiments at least the first flowpath 30 connects to the delivery outlet 18 or 118*a*, 118*b*, 118*c* in order to provide a minimum flow at the highest or earliest point in the handling process. In the fourth embodiment, however, both the first and second flowpaths 330, 334 connect directly to and introduce their respective flows into the processing device 324 itself, thereby providing increased flow for the grinding or shredding and flushing aspects. It will be appreciated that this fourth embodiment of the control system 314 can, as desired, be incorporated into a single-operator system, such as is shown in FIG. 1, or into a multi-operator trough-type system, such as is shown in FIG. 3.

Figure 6:
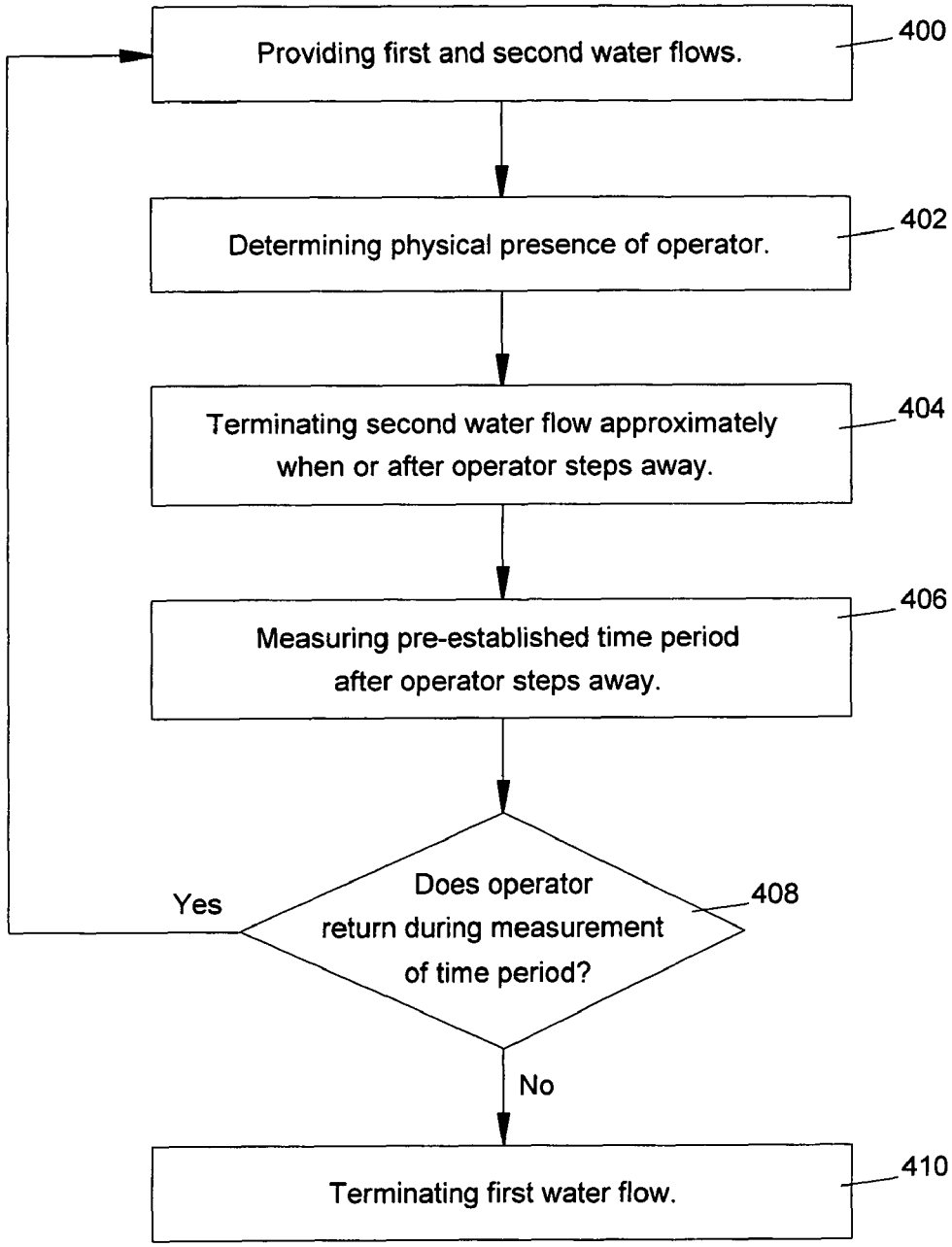
FIG. 6 is a high-level flowchart of steps involved in practicing a preferred first implementation of the method of the present invention.

In exemplary use and operation, the various embodiments of the control system of the present invention may be implemented to function generally as follows. Referring to FIG. 6, an operator physically approaches and manually powers the waste handling system by, e.g., actuating an ON switch which causes both valves to automatically open in order to provide maximum combined water flow, as indicated by box 400. The proximity sensor detects the operator's initial and continued presence, as indicated by box 402. When or a few seconds or minutes after the operator's presence is no longer detected, indicating that he or she has stepped away from the basin and is no longer depositing waste, the second flowpath closes, thereby substantially reducing but not eliminating water flow, as indicated by box 404, and the controller initiates the internal timer to measure the pre-established time period during which the first flowpath remains open to continue facilitating aspects of the handling process still in progress, as indicated by box 406. If the operator's presence is re-detected before the measured time period ends, as indicated by the YES branch of decision box 408, then the second flowpath re-opens, and when the operator steps away again the internal timer is re-initiated to begin measuring the pre-established time period from the beginning. If the operator's presence is not re-detected before the measured time period ends, as indicated by the NO branch of decision box 408, then the first flowpath closes and power is automatically removed from the waste handling system, by, e.g., automatically actuating an OFF switch, as indicated by box 410.

In another implementation of the present invention, which may be substantially similar or identical to the above-described embodiments but for the following differences, the first flow is maintained at all times while the waste handling system is powered, and the second flow is provided only when the operator's presence is detected and for a pre-established period following cessation of said presence. To be clear: in the first implementation of the embodiments described above, both flows are initially provided, the second flow ceases when or a few seconds or minutes after the operator's presence ceases, and the first flow ceases following a pre-established time period after the operator's presence ceases; in the presently-described implementation, however, the first flow is provided at all times, the second flow is provided when the operator's presence is detected, and the second flow ceases following a pre-established time period after the operator's presence ceases. Similar variations on controlling the first and second water flows will be evident to those with ordinary skill in the art.

Figure 7:
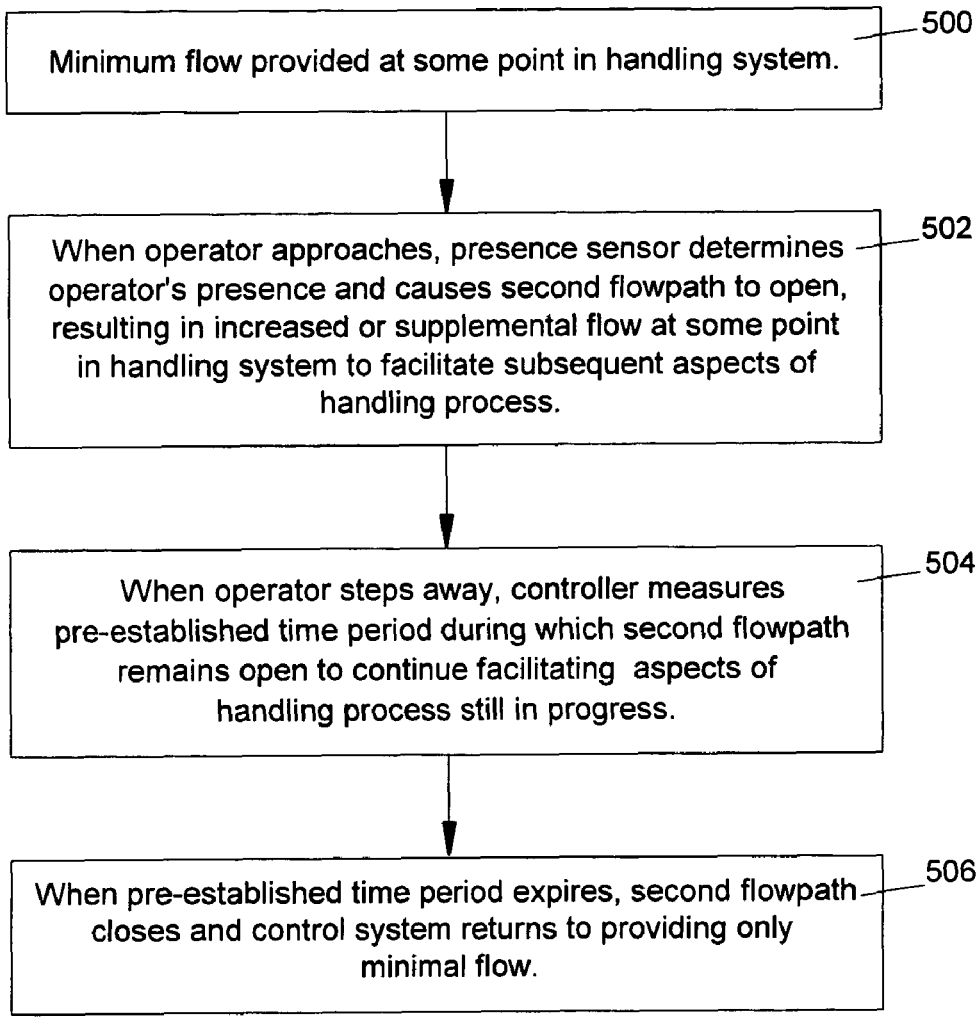
FIG. 7 is a high-level flowchart of steps involved in practicing a preferred second implementation of the method of the present invention.

In exemplary use and operation, the presently-described implementation of the control system of the present invention may function generally as follows. Referring to FIG. 7, whenever the waste handling system is powered, the first flow is provided at some point in the waste handling system, whether earlier or later in the handling process, as indicated by box 500. When an operator approaches the waste handling system to deposit food waste thereinto, the presence sensor determines the operator's presence and causes the second flowpath to open, resulting in an increased or supplemental flow at the same or a different point in the waste handling system, as indicated by box 502. When the operator is finished and steps away, the controller initiates the timer to measure a pre-established time period during which the second flowpath remains open to continue facilitating aspects of the handling process still in progress, as indicated by box 504. When the pre-established time period has expired, the second flowpath closes, and the control system returns to providing only the first flow, as indicated by box 506, thereby conserving water and reducing operating costs.

Thus, both implementations described herein provide for substantially automatically controlling water flow into a food waste handling system based on a determined physical presence of an operator, including automatically controlling said flow for a pre-established period of time following cessation of said presence.

From the preceding description it will be appreciated that the control system and method of the present invention provides a number of substantial advantages over the prior art, including, for example, automatically controlling water flow to facilitate all or certain aspects of the handling process. By contrast, the prior art provides increased water flow only during the grinding or shredding process and only in response to increased current draw. Furthermore, the present invention continues to provide water flow for a pre-established period of time in order to facilitate the handling process to completion. By contrast, the prior art ceases to provide water flow once motor current draw drops to normal levels, but this neither ensures that food waste still traveling to the basin (i.e., down a connecting trough) reaches the basin nor ensures that ground or shredded food waste is adequately flushed into and through a connected sanitary sewer system. Additionally, the present invention is usable with collector-based and other waste handling systems in which there is no current draw or in which current draw is not a satisfactory indicator of a needed increase in water flow.

Although the invention has been described with reference to the preferred embodiments illustrated in the drawings, it is noted that equivalents may be employed and substitutions made herein without departing from the scope of the invention as recited in the claims.

I claim:

1. A control system for controlling water flow into a food waste handling system, the control system comprising:

a presence sensor for determining a physical presence of an operator in close proximity with the food waste handling system;

a timer for measuring a pre-established time period;

a first flow control device for providing a first flow of water into the food waste handling system in response to the presence sensor determining the physical presence of the operator and during the pre-established time period as measured by the timer following cessation of said determined physical presence of the operator; and a second flow control device for providing a second flow of water into the food waste handling system in response to the presence sensor determining the physical presence of the operator, and for terminating said second flow of water approximately simultaneously with the cessation of said determined physical presence of the operator.

2. The control system as set forth in claim 1, wherein the first flow and the second flow are provided into the food waste handling system at substantially the same location.

3. The control system as set forth in claim 1, wherein the first flow and the second flow are provided into the food waste handling system at substantially different locations.

4. A food waste handling system comprising:

a basin;

a processing device connected to the basin for receiving and processing food waste;

and a control system for controlling water flow into the food waste handling system, the control system including— a presence sensor for determining a physical presence of an operator in close proximity with the food waste handling system;

a timer for measuring a pre-established time period, a first flow control device for providing a first flow of water into the food waste handling system in response to the presence sensor determining the physical presence of the operator and during the pre-established time period as measured by the timer following cessation of said determined physical presence of the operator, and a second flow control device for providing a second flow of water into the food waste handling system in response to the presence sensor determining the physical presence of the operator, and for terminating said second flow of water approximately simultaneously with the cessation of said determined physical presence of the operator.

5. The food waste handling system as set forth in claim 4, wherein the first flow and the second flow are provided into the food waste handling system at substantially the same location.

6. The food waste handling system as set forth in claim 4, wherein the first flow and the second flow are provided into the food waste handling system at substantially different locations.

7. The food waste handling system as set forth in claim 4, wherein the processing device includes a disposer device for grinding or shredding the food waste.

8. The food waste handling system as set forth in claim 4, wherein the processing device includes a collector device for accumulating a solid component of the food waste.

9. The food waste handling system as set forth in claim 4, wherein the food waste handling system is a multi-operator system including a trough, and wherein the control system includes a plurality of presence sensors dispersed along a work area associated with the trough.

10. A control system for controlling water flow into a food waste handling system, the control system comprising:

a sensor for detecting an operator in close proximity with the food waste handling system;

a timer for measuring a pre-established time period following cessation of the operator being detected by the sensor;

means for:

(a) providing a first flow of water into the food waste handling system while the sensor detects the operator;

(b) providing the first flow of water into the food waste handling system during the measured pre-established time period; and (c) terminating the first flow of water upon expiration of the measured pre-established time period; and means for:

(a) providing a second flow of water into the food waste handling system while the sensor detects the operator; and (b) terminating the second flow of water when the sensor ceases detecting the operator, the first and second flows of water being terminated at different times.

11. The control system of claim 10, wherein:

the means for providing a first flow of water into the food waste handling system while the sensor detects the operator is: means for providing a first flow of water into the food waste handling system for the entire duration that the sensor detects the operator; and the means for providing a second flow of water into the food waste handling system while the sensor detects the operator is: means for providing a second flow of water into the food waste handling system for the entire duration that the sensor detects the operator.

12. A food waste handling system, comprising:

a basin;

a processing device accessible from the basin for receiving and processing food waste; and a control system for controlling water flow into the food waste handling system, the control system comprising:

a sensor for detecting an operator in close proximity with the food waste handling system;

a timer for measuring a pre-established time period following cessation of the operator being detected by the sensor;

means for:

(a) providing a first flow of water into the food waste handling system while the sensor detects the operator;

(b) providing the first flow of water into the food waste handling system during the measured pre-established time period; and (c) terminating the first flow of water upon expiration of the measured pre-established time period; and means for:

(a) providing a second flow of water into the food waste handling system while the sensor detects the operator; and (b) terminating the second flow of water when the sensor ceases detecting the operator, the first and second flows of water being terminated at different times.

13. The food waste handling system of claim 12, wherein the processing device includes a disposer device for breaking up the food waste.

14. The food waste handling system of claim 12, wherein the processing device includes a collector device for accumulating a solid component of the food waste.

15. The food waste handling system of claim 12, wherein the first flow and the second flow are provided into the food waste handling system at substantially the same location.

16. The food waste handling system of claim 12, wherein the means for providing a first flow of water into the food waste handling system while the sensor detects the operator is: means for providing a first flow of water into the food waste handling system for the entire duration that the sensor detects the operator.

17. The food waste handling system of claim 12, wherein the means for providing a second flow of water into the food waste handling system while the sensor detects the operator is: means for providing a second flow of water into the food waste handling system for the entire duration that the sensor detects the operator.

18. The food waste handling system of claim 12, wherein:

the means for:

(a) providing a first flow of Water into the food waste handling system while the sensor detects the operator;

(b) providing the first flow of water into the food waste handling system during the measured pre-established time period; and (c) terminating the first flow of water upon expiration of the measured pre-established time period and the means for:

(a) providing a second flow of water into the food waste handling system while the sensor detects the operator; and (b) terminating the second flow of water when the sensor ceases detecting the operator, the first and second flows of water being terminated at different times are two separate flow control devices.

19. The food waste handling system of claim 12, wherein at least one flow control device is:

the means for:

(a) providing a first flow of water into the food waste handling system while the sensor detects the operator;

(b) providing the first flow of water into the food waste handling system during the measured pre-established time period; and (c) terminating the first flow of water upon expiration of the measured pre-established time period and the means for:

(a) providing a second flow of water into the food waste handling system while the sensor detects the operator; and (b) terminating the second flow of water when the sensor ceases detecting the operator, the first and second flows of water being terminated at different times.

20. The food waste handling system of claim 19, wherein:

the means for providing a first flow of water into the food waste handling system while the sensor detects the operator is: means for providing a first flow of water into the food waste handling system for the entire duration that the sensor detects the operator; and the means for providing a second flow of water into the food waste handling system while the sensor detects the operator is: means for providing a second flow of water into the food waste handling system for the entire duration that the sensor detects the operator.

* * * * *